United States Patent [19]

Gawlick et al.

[11] 4,128,060

[45] Dec. 5, 1978

[54] SHORT-RANGE PROJECTILE FOR PRACTICE AMMUNITION

[75] Inventors: Heinz Gawlick, Vagen Post Feldkirchen-Westerham; Axel Homburg, Bensberg, both of Germany

[73] Assignee: Dynamit Nobel Aktiengesellschaft, Germany

[21] Appl. No.: 785,529

[22] Filed: Apr. 7, 1977

[30] Foreign Application Priority Data

Apr. 13, 1976 [DE] Fed. Rep. of Germany ..... 2616209

[51] Int. Cl.[2] ..... F42B 13/20

[52] U.S. Cl. ..... 102/92.7

[58] Field of Search ..... 102/41, 92, 92.7

[56] References Cited

U.S. PATENT DOCUMENTS

| | | | |
|---|---|---|---|
| 627,929 | 6/1899 | Andrews | 102/92 |
| 1,481,930 | 1/1924 | Schneider | 102/92 |
| 3,208,387 | 9/1965 | Giles | 102/92 |
| 3,747,533 | 7/1973 | Rossmann | 102/92.7 |
| 3,800,706 | 4/1974 | Gawlick | 102/92.7 |

*Primary Examiner*—Verlin R. Pendegrass
*Attorney, Agent, or Firm*—Craig & Antonelli

[57] ABSTRACT

A short-range projectile for practice ammunition having an axial air inlet duct emanating from the front end of the projectile and at least one outlet duct connecting the inlet duct with the jacket of the projectile. At least one of the inlet and outlet ducts are blocked during the initial flight path of the projectile by a blocking member displaceable in a chronologically controlled manner. The blocking member is displaceable in response to an air pressure head occurring during flight of the projectile from a starting position for preventing the influx of air from the inlet duct to the outlet duct to a final position wherein communication and influx of air from the inlet duct to the outlet duct is completely enabled.

24 Claims, 1 Drawing Figure

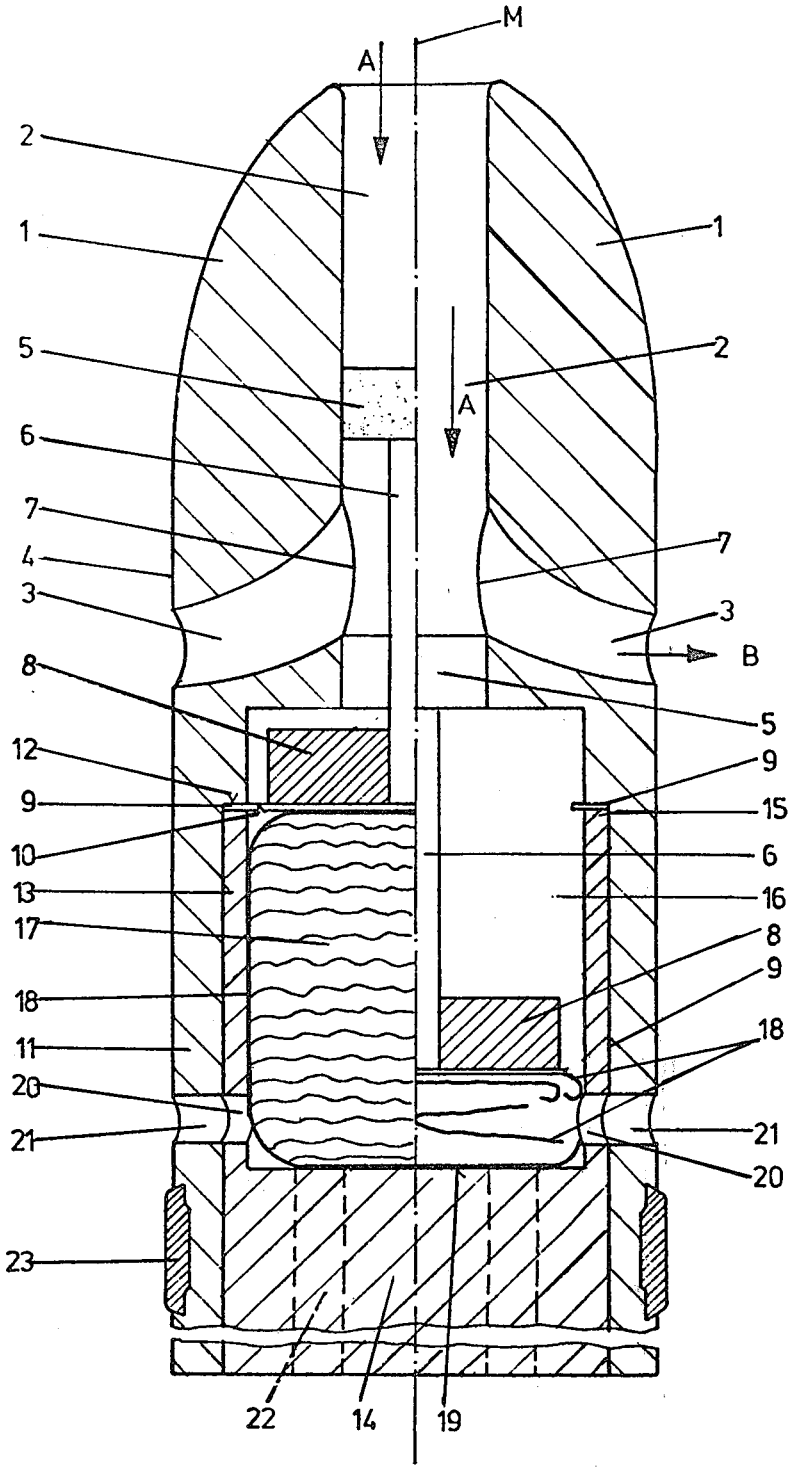
M
A
A
B
1
1
2
2
3
3
4
5
5
6
6
7
7
8
8
9
9
9
10
11
12
13
14
15
16
17
18
18
19
20
20
21
21
22
23

SHORT-RANGE PROJECTILE FOR PRACTICE AMMUNITION

This invention relates to the subject matter recited in the preamble of claim 1.

A short-range projectile for practice ammunition, hereinafter an SR projectile, is disclosed in U.S. Pat. No 3,800,706 and is provided with a central, axial air inlet duct emanating from the front end of the projectile, which inlet duct communicates with the projectile rear end by way of, for example, four lateral, preferably radial outlet ducts open toward the outside. In order to make such an SR projectile approach even more closely the ballistic properties of the original projectile of the live ammunition during a certain trajectory, the training projectile is provided, in accordance with U.S. Pat. No. 3,747,533, with a projectile tip which can be separated while traversing the trajectory and which is held in the inlet duct, the duct having the shape of a blind hole. The tip of this projectile has a cavity to absorb the pressure head causing the separation of the projectile tip, wherein the cavity is sealed at the front by means of a material melting in response to the temperature increase resulting from air resistance while traversing the trajectory. Additionally, the tip of the projectile is fashioned so as to burst and to separate from the body of the projectile by the air pressure head within the cavity.

In the aforementioned SR projectile, however, the bursting and separation of the cap-shaped projectile tip does not take place with the desired reproducibility, so that the fluctuations with respect to the instant of separation and thus the increase in resistance are undesirably high. A cause for these deviations are the manufacturing tolerances of the projectile nose, i.e., for example, its varying wall thickness, and the influence of fluctuating ambient temperatures —which can amount during practice firing, for example, to a range between −30° and +50° C.—on the melting and strength properties of the projectile nose which is made of a synthetic resin, for example.

It is therefore an objection of the present invention to provide an SR projectile which overcomes the aforementioned disadvantages of the prior art.

It is another object of the present invention to provide an SR projectile having an axial air inlet duct emanating from the front end of the projectile and with at least one lateral extending outlet duct connecting the inlet duct with the jacket of the projectile and with at least one of the inlet and outlet ducts being closed during the initial flight path of the projectile, the SR projectile being constructed especially for medium and large calibers so that the requirement for uniformity of trajectory and flight time with those of combat ammunition is maximally completely fulfilled within the training range, and the ballistic behavior can be flawlessly reproduced even under training conditions which vary greatly in practice.

In accordance with the present invention, there is provided an SR projectile constructed with an axial air inlet duct emanating from the front end of the projectile and connected with at least one laterally extending outlet duct opening in the jacket of the projectile with at least one of the inlet and outlet ducts being closed during the initial flight path of the projectile. A piston is disposed within the inlet duct for displacement in a chronologically controlled manner under the effect of the air pressure head occurring during flight of the projectile from a starting position which prevents influx of air into the outlet duct by blocking communication of the inlet and outlet ducts into a final position wherein communication and influx of air between the inlet and outlet ducts is completely enabled.

In the SR projectile according to the present invention, the ballistics initially correspond entirely to that of the original projectile, and a change in the flight path is effected only after a time determined in correspondence with the requirements. Such change is achieved by initiating upon firing a controlled shifting of the piston within the blind-hole-type air inlet duct which does not instantaneously lead to an opening up of the at least one outlet duct, but leads to such opening up only after a time which can be set by the piston movement. By this opening procedure, the strongly braking increase in the resistance begins at a predetermined point in time, caused by the axial entrance impulse of the air and its lateral discharge by way of the at least one outlet duct, and results in the intended shortening of the range.

According to an embodiment of the present invention, the piston is retained in its starting position by a holding arrangement which can be released upon firing of the projectile. The holding arrangement can be constructed, for example, as a threaded, glued or cemented connection with a predetermined strength. However, holding elements are preferred, such as, for example, radially arranged shear pins or other predetermined breaking elements which securely fix the piston in the starting position, until firing, against stresses during transport, handling, etc. and which are flawlessly severed by the firing shock or optionally also by the pressure head of the air effective on the piston during firing. Thus, the piston is advantageously unlocked only upon firing and thereafter can execute its chronologically controlled movement.

An especially advantageous control of the piston movement is provided by having the piston displace a flowable mass arranged within a displacement chamber of the projectile during displacement of the piston into its final position. The displacement of the flowable mass depends, for example, on the viscosity thereof and on the flow conditions, for example, on the size of a throttle bore, and makes it possible to adjust the piston velocity between the starting position and the final position of the piston, in dependence on the occurring forces, to the required value.

The flowable mass can be a liquid, but it can also be a gel, a paste, or the like, assuming the flowable condition only under the effect of a force. The flow characteristic of the composition should be maximally independent of temperature at the ambient temperatures at which the SR projectile can be deployed. Silicone oil is the preferred material for the flowable composition. However, it is also possible to utilize other lubricants, such as, for example, engine oils or in certain cases also paraffin- or wax-like compounds and/or mixtures. Optionally, it is also possible to use compounds such as n-butyl alcohol, isoamyl alcohol n-butyl bromide, glyceryl triacetate, or the like. The substance best suitable in each particular case is chosen in correspondence with the respective temperature range wherein the SR projectile is to be utilized, the viscosity of the substance, the forces effective thereon, and so forth.

The flowable mass or compound can be displaced, for example, from a first portion of the displacement chamber via one or several throttle bores into a second portion which is empty until firing of the projectile. The second portion can be located behind the first portion or so that it surrounds this first portion, for example, in an annular configuration. However, preferably, the flowable mass is ejected from the projectile via at least one bore.

To prevent, if necessary, the flowable composition from exiting the displacement chamber and/or the first portion thereof already prior to the onset of the piston movement, the bores, openings, or the like can be sealed, for example, with bursting diaphragms. However, it is also possible according to an embodiment of the present invention to employ an additional container which can be destroyed during firing or in response to the action of an air pressure head, this container holding the flowable composition and being inserted in the displacement chamber.

In accordance with a further feature of this invention, the piston is associated with an additional, heavy substance or member which, upon firing of the projectile, exerts an additional separating force on the piston holding arrangement and thus enhances the release of the piston. Depending on the particular arrangement, this additional substance, displaceable within the body of the projectile under the effect of the firing forces, can also effect, for example, the destruction of the container of the flowable composition.

The additional substance can be displaceable independently of the piston, i.e., it need not be connected thereto. However, a fixed connection of piston and additional substance is preferred as, for example, by way of a piston rod connecting the additional substance to the rear of the piston. In this connection, the additional substance which is, for example, in the form of a disk or a ring, acts furthermore simultaneously as the displacement element for the flowable compound, this element being supported toward the rear on the holding arrangement for the piston until the instant of firing. The additional substance can be initially in contact with this holding arrangement or can also be located at a minor distance therefrom and can then come into contact with the holding arrangement, for example, only after a corresponding impact stress has been exerted thereon during transport. An especially advantageous construction and arrangement of the holding arrangement is a holding arrangement in the form of a bursting diaphragm clamped between a hollow cylindrical wall of the projectile and a closure element inserted from the rear and forming a chamber for the flowable mass.

Other objects, features and advantages will become apparent by reference to the single FIGURE of drawing illustrating for explanatory purposes only one embodiment of the present invention.

The FIGURE shows the SR projectile in a longitudinal sectional view, namely, on the one hand, in its condition prior to firing and, on the other hand, in its condition after firing. To simplify the drawing, the projectile is shown in each case only in half a section. The two half sections are separated from each other by the line of symmetry M.

The left-hand half of the FIGURE shows the SR projectile before firing. The inlet duct 2 and the lateral outlet duct 3 are formed in the body 1 of the projectile which is made, for example, of steel. Preferably, two or more outlet ducts 3 are provided in uniform distribution over the circumference of the projectile. The outlet duct 3 terminates almost perpendicularly in a jacket 4 of the projectile and in the present illustrated embodiment is open. A piston 5 and its piston rod 6, both made, for example, of a synthetic resin such as PVC or polyethylene, are disposed within the inlet duct 2 to be readily displaceable therein. The piston 5 is initially arranged in front of a transition region 7 from the inlet duct 2 into the outlet duct 3, so that the air which has penetrated into the inlet duct 2 in accordance with arrow A is prevented from continuing its flow into the outlet duct 3 by the piston 5.

At the rear end of the piston rod 6 and fixedly joined thereto, a disk-shaped additional member or substance 8 made of steel, for example, is disposed and is supported toward the rear against a bursting diaphragm 9. The bursting diaphragm 9, made of steel, for example, is preferably provided with a predetermined breaking zone, for example, an annular notch 10, and is clamped between an annular shoulder 12 fashioned in the wall 11 of the projectile and a closure element 14 firmly inserted in the cylindrical recess 13 of the projectile wall 11, for example, with a press-fit. A flowable mass 17 is disposed within a thin-walled container 18 which may be produced from a synthetic resin, e.g., a polyethylene sheet, or another material and optionally provided with predetermined rupturing lines. The container is arranged within a recess 16 emanating from the front end 15 of the closure element 14, which element is made of steel, for example. The outer diameter of the additional member 8 is only a little smaller than the inside diameter of the recess 16, so that the additional member 8 acts as a displacement element for the flowable composition 17.

In the close proximity of the bottom 19 of the recess 16, two or more radial openings 20 are provided in a uniform distribution over the circumference in the closure element 14, and openings 21 corresponding thereto are provided in the projectile wall 11. However, in place of the radial openings 20, 21, or in addition thereto, it is also possible to fashion, for example, axial openings 22 in the bottom 19 of the closure element 14, as indicated in dashed lines. The openings 22 can serve, if desired, for making the gases of the propellant charge during firing indirectly or directly effective on the holding means for the piston 5, thus unlocking the latter. The discharge openings for the flowable composition 17 are to be arranged and constructed so that no transverse forces are exerted on the SR projectile, which would interfere with its flight characteristics. The guide strip 23 is disposed in the zone of the rear of the projectile which, in this embodiment, prevents the entrance of the propellant charge gases during firing into the openings 20, 21.

Upon firing this SR projectile, the thus-occurring acceleration forces press the additional member 8 and the piston 5 connected therewith toward the rear with such a force due to its mass moment of inertia that the bursting diaphragm 9 is destroyed and thus the piston 5 is released. The air pressure head effective on the piston 5 in correspondence with arrow A is now transmitted to the container 18 and leads to its breaking, rupturing, or the like. The flowable mass 17 present in the container 18 can now be ejected, under the pressure effect of the piston 5 and of the additional substance 8, via the openings 20, 21 and the piston 5 can be displaced toward the rear with corresponding chronological control until it has reached the final position shown in the right-hand half of the FIGURE at a predetermined point in time after firing. In this final position, the transition region 7 from the inlet duct 2 into the outlet duct 3 is entirely freed, so that the air can enter the SR projectile according to arrow A and can be discharged according to arrow B practically radially from the outlet ducts 3. In this final position, the resistance-increasing effect due to the throughflow of the air becomes fully effective. In this connection, a control can be exerted on the increase of the resistance in dependence of the inclination of the air jet laterally exiting at the jacket 4 of the projectile. The resistance is increased if the air exits obliquely toward the front and is reduced if the air exits with an orientation which is directed obliquely rearwardly.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A short-range projectile for practice ammunition comprising axial air inlet duct means emanating from the front end of the projectile, at least one outlet duct means connecting the inlet duct means with the jacket of the projectile, at least one of the inlet and outlet duct means being blocked during the initial flight path of the projectile, and blocking means for blocking one of the inlet and outlet duct means, the blocking means being displaceable within the projectile in a chronologically controlled manner in response to an air pressure head occurring during flight of the projectile from a starting position in the projectile for preventing the influx of air from the inlet duct means to the outlet duct means to a final position in the projectile wherein communication and influx of air from the inlet duct means to the outlet duct means is completely enabled.

2. A short-range projectile according to claim 1, wherein the blocking means includes a piston means arranged in the inlet duct means and displaceable from a starting position blocking a transition region between the inlet duct means and the outlet duct means to a final position wherein the transition region is unblocked.

3. A short-range projectile according to claim 2, further comprising holding means for retaining the piston means in the starting position, the holding means being releasable upon firing of the projectile.

4. A short-range projectile according to claim 3, wherein the holding means includes at least one holding element.

5. A short-range projectile according to claim 2, wherein the projectile includes a displacement chamber therein, a flowable mass being provided in the displacement chamber, the piston means during the displacement thereof into the final position displacing the flowable mass.

6. A short-range projectile according to claim 5, wherein the projectile is provided with bore means for enabling ejection of the flowable mass from the projectile.

7. A short-range projectile according to claim 5, further comprising container means disposed within the projectile for enclosing the flowable mass, the container means being responsive to at least one of firing of the projectile and the action of the air pressure head for being destroyed.

8. A short-range projectile according to claim 7, wherein the container means includes a thin-walled container.

9. A short-range projectile according to claim 6, further comprising container means disposed within the projectile for enclosing the flowable mass, the container means being responsive to at least one of firing of the projectile and the action of the air pressure head for being destroyed.

10. A short-range projectile according to claim 9, wherein the container means includes a thin-walled container.

11. A short-range projectile according to claim 3, further comprising separating means associated with the piston means for exerting during firing of the projectile a separating force on the holding means due to its mass moment of inertia.

12. A short-range projectile according to claim 3, further comprising separating means associated with the piston means for exerting during firing of the projectile a separating force on the holding means due to its mass moment of inertia.

13. A short-range projectile according to claim 12, wherein the separating means is constructed as a displaceable element for displacing the flowable mass, and connecting means for connecting the displaceable element and the piston means.

14. A short-range projectile according to claim 13, wherein the holding means limits the displaceability of the displaceable element until the firing of the projectile.

15. A short-range projectile according to claim 14, wherein the connecting means is a piston rod connecting the displaceable element to the rear portion of the piston means.

16. A short-range projectile according to claim 15, wherein the holding means is a bursting diaphragm, the bursting diaphragm being clamped between the hollow cylindrical wall of the projectile and a closure element inserted from the rear of the projectile and delimiting a chamber for the flowable mass.

17. A short-range projectile according to claim 4, wherein the projectile includes a displacement chamber therein, a flowable mass being provided in the displacement chamber, the piston means during the displacement thereof into the final position displacing the flowable mass.

18. A short-range projectile according to claim 17, wherein the projectile is provided with bore means for enabling ejection of the flowable mass from the projectile.

19. A short-range projectile according to claim 18, further comprising container means disposed within the projectile for enclosing the flowable mass, the container means being responsive to at least one of firing of the projectile and the action of the air pressure head for being destroyed.

20. A short-range projectile according to claim 19, further comprising separating means associated with the piston means for exerting during firing of the projectile a separating force on the holding means due to its mass moment of inertia.

21. A short-range projectile according to claim 20, wherein the separating means is constructed as a displaceable element for displacing the flowable mass, and connecting means for connecting the displaceable element and the piston means.

22. A short-range projectile according to claim 21, wherein the holding means limits the displaceability of the displaceable element until the firing of the projectile.

23. A short-range projectile according to claim 22, wherein the connecting means is a piston rod connecting the displaceable element to the rear portion of the piston means.

24. A short-range projectile according to claim 23, wherein the holding means is a bursting diaphragm, the bursting diaphragm being clamped between the hollow cylindrical wall of the projectile and a closure element inserted from the rear of the projectile and delimiting a chamber for the flowable mass.

* * * * *